US007233291B2

(12) United States Patent
Elkobi et al.

(10) Patent No.: US 7,233,291 B2
(45) Date of Patent: Jun. 19, 2007

(54) ANTENNA STRUCTURES AND THEIR USE IN WIRELESS COMMUNICATION DEVICES

(75) Inventors: Motti Elkobi, Netanya (IL); Maksim Berezin, Netanya (IL); Yona Newman, Ra-Anana (IL)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/068,373

(22) Filed: Feb. 28, 2005

(65) Prior Publication Data

US 2005/0200535 A1 Sep. 15, 2005

(30) Foreign Application Priority Data

Aug. 28, 2003 (WO) ..... PCT/EP03/50389

(51) Int. Cl.
*H01Q 1/24* (2006.01)

(52) U.S. Cl. ..... 343/702; 343/700 M; 343/846

(58) Field of Classification Search ..... 343/702, 343/700 MS
See application file for complete search history.

(56) References Cited

U.S. PATENT DOCUMENTS 5,001,492 A * 3/1991 Shapiro et al. ..... 343/700 MS
5,608,413 A * 3/1997 Macdonald ..... 343/700 MS
6,061,024 A * 5/2000 McGirr et al. ..... 343/700 MS
6,448,931 B1 * 9/2002 Deguchi et al. ..... 343/700 MS
6,483,462 B2 * 11/2002 Weinberger ..... 343/700 MS
6,483,463 B2 * 11/2002 Kadambi et al. .... 343/700 MS
6,630,906 B2 * 10/2003 Tomomatsu et al. . 343/700 MS
6,642,892 B2 * 11/2003 Masaki et al. ..... 343/702
6,768,460 B2 * 7/2004 Hoashi et al. ..... 343/700 MS
6,801,164 B2 * 10/2004 Bit-Babik et al. ... 343/700 MS
6,889,066 B2 * 5/2005 Gupta et al. ..... 455/570
2004/0252058 A1 * 12/2004 Rawnick et al. ..... 343/700 MS

* cited by examiner

*Primary Examiner*—Don Wong
*Assistant Examiner*—Binh Van Ho
(74) *Attorney, Agent, or Firm*—Barbara R. Doutre

(57) ABSTRACT

An antenna structure for use in a wireless communication device, the structure comprising (i) a plurality of antenna portions each having a substantially planar radiating surface and (ii) a conducting ground portion; wherein the radiating surfaces of the antenna portions are substantially parallel to one another in a side-by-side relationship and are substantially parallel to part of the conducting ground portion located behind the antenna portions with respect to a direction of transmission of radiation from the antenna portions, the conducting ground portion comprising a first part galvanically connected to each of the antenna portions and, electrically coupled to the first part, a second conducting part forming at least part of a cover for a wireless communication device.

10 Claims, 5 Drawing Sheets

ANTENNA STRUCTURES AND THEIR USE IN WIRELESS COMMUNICATION DEVICES

RELATED APPLICATIONS

This Application claims priority from Application No. PCT/EP2003/050389, filed Aug. 28, 2003, which claims priority from United Kingdom Application No. 0220113.5 which issued as Patent No. GB2392563 on Nov. 3, 2004.

FIELD OF THE INVENTION

The present invention relates to antenna structures and their use in wireless communication devices. In particular, the invention relates to antenna structures for use in portable communication devices such as handsets.

BACKGROUND OF THE INVENTION

Various antenna types are known for use in handheld communication devices. For example, monopole and dipole antennae, patch and so called planar inverted 'F' (PIF) antennae are all known for this application.

Some modern wireless communication devices are designed for multi-mode use in more than one communication system. Generally, dedicated multiple antennae are required for use in each separate mode in which the device is to operate. In some cases, devices are to be designed for operating in more than one mode and this can require the overall antenna structure to be large. This is undesirable where there are practical space and size constraints on the antenna structure and on other components used in the device.

In addition, some antenna structures operating in a so called space diversity arrangement include multiple active antenna portions even when they operate in a single communication mode or system. The space diversity arrangement can require the overall antenna structure to be unduly large.

The purpose of the present invention is to provide a novel antenna structure including multiple active antenna portions suitable for use in a portable wireless communication device such as a mobile handset which facilitates use in multiple operational modes.

SUMMARY OF THE PRESENT INVENTION

According to the present invention in a first aspect there is provided an antenna structure including at least two antennae for use in a wireless communication device, the structure comprising a (i) a plurality of antenna portions each having a substantially planar radiating surface; (ii) a first conducting ground portion; and (iii) a second conducting ground portion; wherein the radiating surfaces of the antenna portions are substantially parallel to one another in a side-by-side relationship and are substantially parallel to the first conducting ground portion and (at least part of) the second conducting ground portion, and the first and second conducting ground portions are located behind the antenna portions with respect to a direction of radiation from the antenna portions, the first conducting ground portion being galvanically connected to each of the antenna portions and electromagnetically coupled to the second conducting ground portion, wherein the second conducting ground portion comprises a conducting structural part of the wireless communication device. The conducting structural part may comprise a conducting housing, case, cover, or the like, of the wireless communication device.

The electromagnetic coupling from the first conducting ground portion of the antenna structure to the second conducting ground portion comprises a capacitive, inductive or galvanic coupling or a combination of two or more of these. Where a capacitive coupling is used, a dielectric material, e.g. a dielectric plastics layer, may be provided between the first and second conducting ground portions. The dielectric material may have a permittivity of between 2.0 and 3.0, especially between 2.5 and 3.0.

In the antenna structure according to the first aspect of the invention, the antenna portions and the conducting ground portions may be conducting plates. The plates may for example be made partially (e.g. by surface plating or coating) or wholly of a highly conducting metal as used in the art, e.g. a nickel/silver alloy or copper or a copper alloy. The plates may all be formed from a single sheet of metal, e.g. by shaping and bending as illustrated later. The plate which forms the first conducting ground portion may be a substantially rectangular plate and the plates which are antenna portions may be substantially square plates. The plates which are antenna portions may together define an envelope having an area not greater than that of the ground portion plate. Preferred sizes and relative separations of the plates are as described later.

Two R.F. signal leads, e.g. co-axial feed cables, may be connected to the antenna structure in such a manner that a first conductor of each lead is connected to the first conducting ground portion and a second conductor of each lead is connected to a respective one of the antenna portions. The leads, e.g. cables, may extend through respective holes in the first conducting ground portion to contact the antenna portions.

These antenna portions together with the first conducting ground portion provide so called PIF (planar inverted F) antennae which provide transmission of substantially omnidirectional R.F. radiation in an azimuth cut (horizontal plane) as illustrated later. As noted earlier, PIF antennae are one of a variety of antenna forms which are known per se. However, their selection and use in the antenna structure of the invention is inventive for the reasons described later. Other known forms of antenna would be unsuitable for use in multi-mode communications devices. For example, a multiple monopole antenna would require an unduly large space and it would be difficult to achieve a suitable isolation between the two antennae. Multiple dipole antennae would also require an unduly large space and would be complicated by their dual polarisation requirements. Patch antennae would require an unduly large space and would produce both polarisation and isolation problems which would be difficult to solve.

According to the present invention in a second aspect there is provided a data communications device incorporating an antenna structure according to the first aspect. The device may for example be a handset for use in data communications. It may provide communications in a single operational mode, or in two or more modes. The operational mode (or at least one of the operational modes) may be high frequency, e.g. having an operational frequency of 1 GHz or and more, e.g. 2 to 5 GHz. The device may include a housing, case, cover, or the like (or a plurality of parts thereof), made partly or wholly of conducting material, e.g. a metal such as a known alloy of magnesium, which provides the second conducting ground portion.

The antenna structure of the present invention beneficially is suitable for use in a multi-antenna communications device such as a mobile or portable handset terminal operating at one or more high frequencies and can surprisingly be provided in a form which is compact and space saving yet providing a good operational performance. It can give a good omnidirectional radiation pattern in azimuth cut and a high peak gain by each of two or more antennae formed by the structure. It can provide good isolation between these antennae. It may be produced in a relatively cheaply and easily form.

Embodiments of the present invention will now be described by way of example with reference to the accompanying drawings, in which:

BRIEF DESCRIPTION OF THE ACCOMPANYING DRAWINGS

FIGS. 1*a* and 1*b* show a simplified plan and side view of a typical known PIF antenna.

FIGS. 2*a* and 2*b* show a simplified plan and side view of a PIF antennae structure having two antenna portions and a common single ground plane.

FIGS. 3*a* and 3*b* shows a simplified plan view and side view of a PIF antenna structure, embodying the present invention, including two antenna portions and first and second conducting ground portions.

DESCRIPTION OF EMBODIMENTS OF THE INVENTION

Figure 1A:
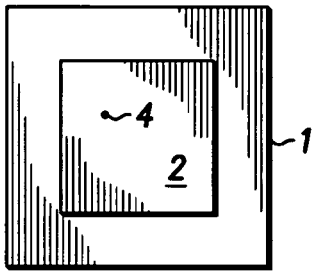
Figure 1B:
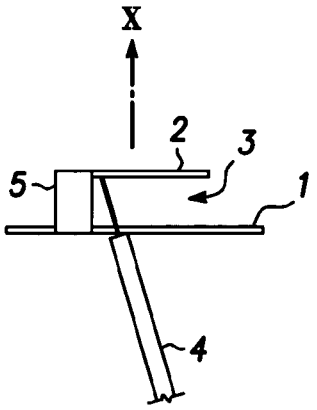

FIGS. 1*a* and 1*b* show one known form of a typical PIF antenna. FIG. 1*a* shows a plan view and FIG. 1*b* shows a side view of the same antenna. The PIF antenna includes a conducting ground plane 1, a conducting radiation element 2 parallel to the ground plane 1, a dielectric insulating material 3 (which can be air) between these and a signal feed line 4. The feed line 4 includes an inner conductor and an outer conductor. The inner conductor connects the radiation element 2 to active R.F. transceiver circuitry (not shown). The outer conductor connects the ground plane 1 to active R.F. transceiver circuitry (not shown). A grounding pin 5 electrically connects the ground plane 1 and the radiation element 2. R.F. signals produced by the transceiver circuitry are fed via the feed line 4 to the radiation element 2 and are transmitted by the radiation element 2 into the surrounding space. Similarly incoming R.F. signals are picked up by the element 2 and passed for reception to the R.F. transceiver circuitry via the feed line 4.

Known theory shows that the ground plane 1 has to have a minimum dimension of least $\lambda/4$ and the radiation element 2 has to have a minimum dimension of $\lambda/8$, where $\lambda$ is the mean wavelength of radiation to be transmitted or received.

Figure 2A:
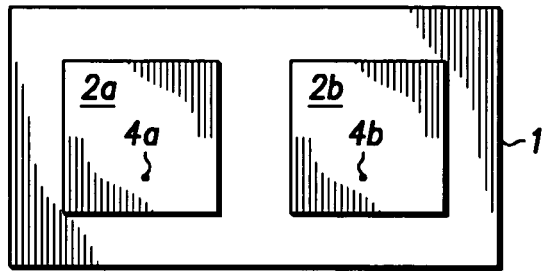
Figure 2B:
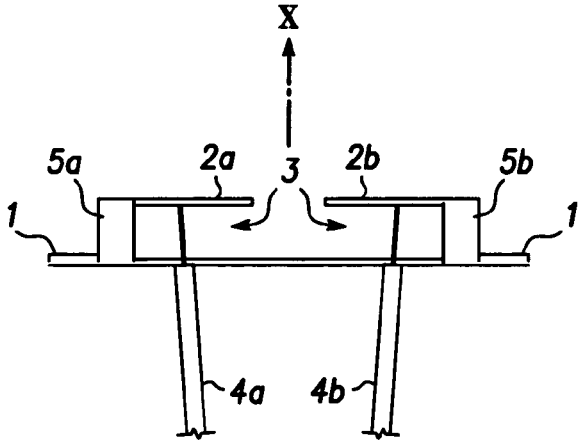

FIGS. 2*a* and 2*b* show a form of PIF antenna structure which includes multiple PIF radiating elements and a common ground plane. FIG. 2*a* shows a plan view and FIG. 2*b* shows a side view of the same antenna structure. The PIF multiple antenna structure of FIGS. 2*a* and 2*b* includes a common ground plane 1, dual radiation elements 2*a* and 2*b* parallel to the ground plane 1, a dielectric insulating material 3 between these (again this can be air), signal feed lines 4*a* and 4*b* which connect the elements 2*a*, 2*b* respectively to active RF transceiver circuitry (not shown) and grounding pins 5*a*, 5*b* which electrically connect the ground plane 1 and the radiation elements 2*a* and 2*b* respectively. R.F. signals produced by the transceiver circuitry are fed via the feed line 4*a* or 4*b* (whichever is activated by connection of a switch in the transceiver circuitry) to the appropriate radiation element 2*a*, 2*b*. The R.F. signals are transmitted by the radiation element 2*a* or 2*b* generally into the surrounding space. Similarly incoming R.F. signals are picked up by the element 2*a* or 2*b* and passed for reception to the R.F. transceiver via the feed line 4*a* or 4*b* as appropriate. Known theory shows that in order to avoid interaction between the two active radiation elements 2*a* and 2*b* there should be a separation of at least $\lambda/8$ between these elements. Also, the ground plane 1 (for two antennae) needs to have a minimum length of at least $\lambda/2$. These minimum dimension requirements conflict with the ergonomic requirements for such equipment to be small and easy to hold in the hand.

Figure 3A:
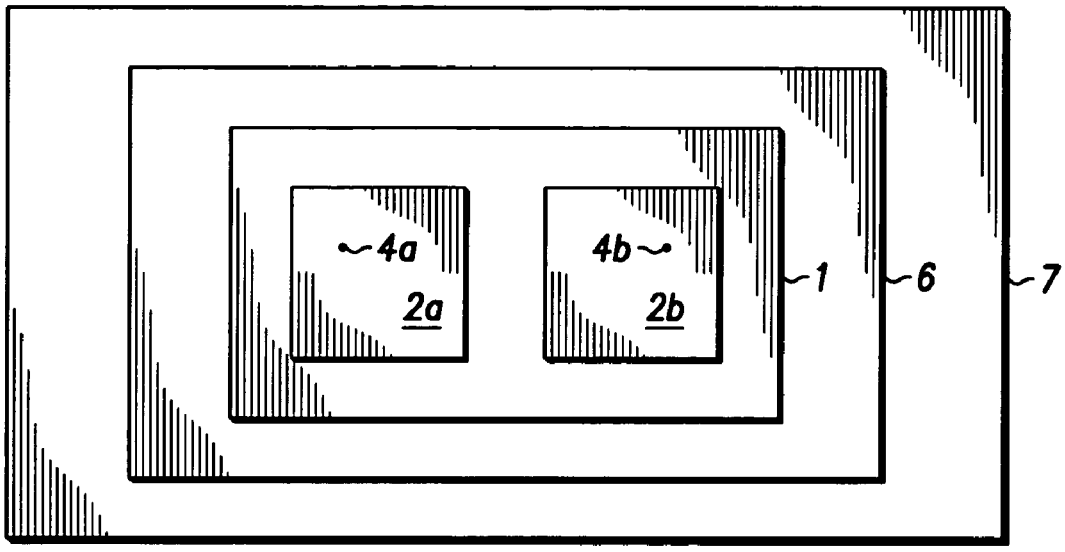
Figure 3B:
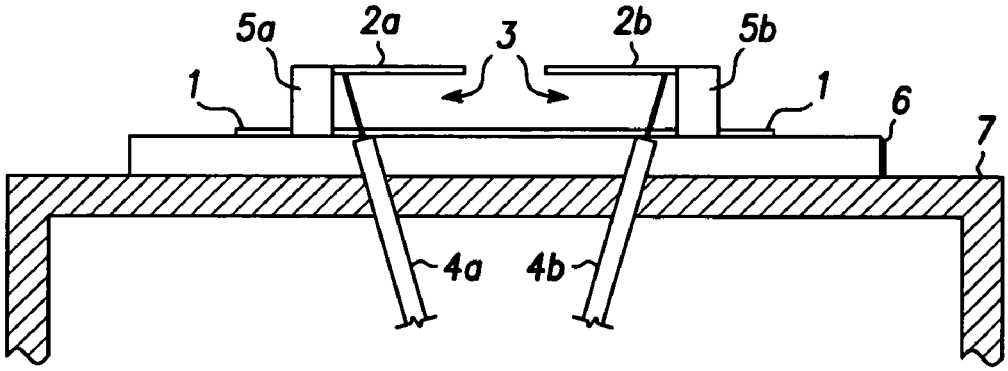

FIGS. 3*a* and 3*b* show a further form of multiple antenna structure embodying the invention which includes two PIF radiating elements and two ground planes. In FIG. 3, (a) shows a plan view and (b) shows a side view (partly in cross section) of the same antenna structure. Like items in FIGS. 2*a* and 2*b* and in FIGS. 3*a* and 3*b* have like reference numerals. The antenna structure of FIG. 3 again includes a common ground plane 1, dual radiation elements 2*a* and 2*b* parallel to the ground plane 1, a dielectric insulating material 3 between these (again this can be air), signal feed lines 4*a* and 4*b* which connect the elements 2*a*, 2*b* respectively to active R.F. transceiver circuitry (not shown) and the ground plane 1, and grounding pins 5*a*, 5*b* which electrically connect the ground plane 1 and the radiation elements 2*a* and 2*b* respectively. The structure shown in FIG. 3 includes also a conductive casing 7 (the second ground plane), which serves as a casing for various known components (for example active R.F. transceiver circuitry, not shown) of a communications handset of which the antenna structure forms a part. The casing 7 is shown in FIG. 3*b* as a sheet with perpendicular ends for simplicity but in practice will have a shape providing an encasing function as illustrated later. The ground plane 1 is separated from the casing 7 by a layer 6 of a dielectric material such as a layer of plastics material. In this case, the ground plane 1 is physically separated from, but capacitively coupled to, the conductive casing 7 via the layer 6. This coupling to the casing 7 allows the casing 7 to form part of the ground plane and effectively increases the ground plane surface area so allowing for an actual reduction in overall size of the physical multiple PIF antenna structure (components 1 to 5).

A double element PIF antenna designed in the form shown in FIGS. 2*a* and 2*b* for use in known Bluetooth and data (IEEE 802.11b) communication applications, both of which use the 2.4 GHz frequency band, would normally require a ground plane surface area of about 62 mm by 31 mm, which is λ/2 by λ/4. However, the conductive casing 7 of FIG. 3 may for example have a surface area of about 92 mm by 30 mm, in other words approximately 150% of the normally required ground plane area. Thus, beneficially, the new antenna structure shown in FIG. 3 can have a smaller physical multiple PIF antenna structure (components 1 to 5) allowing the plate forming the ground plane 1 to have a surface area of 49 mm by 21 mm (in the 2.4 GHz example), which is 50% less than the normally required ground plane area in the antenna structure form shown in FIG. 2.

Furthermore, the radiation elements 2*a* and 2*b* in the embodiment shown in FIGS. 2*a* and 2*b* may beneficially be increased in size to 19 mm by 19 mm mm from the dimensions of 15.5 mm by 15.5 mm, which is λ/8 by λ/8, in order to increase the antenna gain.

This embodiment of the invention allows the separation between the radiation elements to be reduced from the normally required 15.5 mm (at 2.4 GHz) in the FIG. 2 form, to only 10 mm in the FIG. 3 form, without impairing the performance of the two radiation elements 2*a*, 3*a* in the FIG. 3*a*/FIG. 3*b* embodiment.

It will be appreciated by those of ordinary skill in the art, that there is a direct relationship between the increased virtual ground plane area provided by the capacitively coupled casing 7 in FIGS. 3*a* and 3*b* and the possible reductions available in antenna ground plane area and separation of the radiation elements.

The new antenna design provided by this embodiment of the invention includes all of the benefits of the standard PIFA design, including full control of impedance with VSWR better than 2, radiation pattern and polarisation by appropriate positioning of the radiation elements with respect to the ground plane edges, and positioning of the grounding pin and signal feed line.

The two-antenna structure embodying the invention may have dual (vertical/horizontal) polarisation to ensure good signal transfer regardless of the orientation of the device in which the two antenna structure is incorporated.

FIGS. 4 to 11 illustrate use of a practical form of the two-antenna structure shown in FIG. 3 used in a communications handset.

Figure 4:
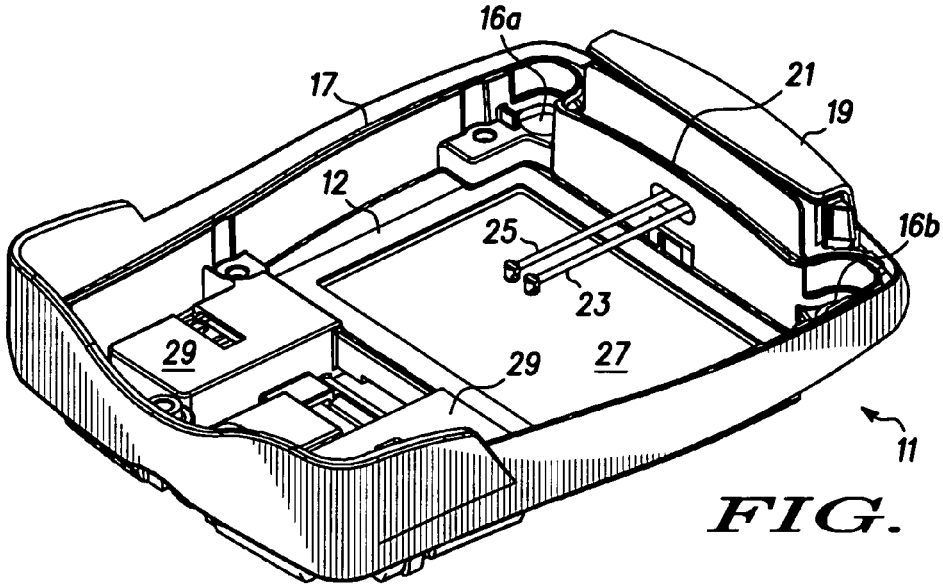
FIG. 4 is a cut away perspective view of a carrier of the data communications handset.
Figure 5:
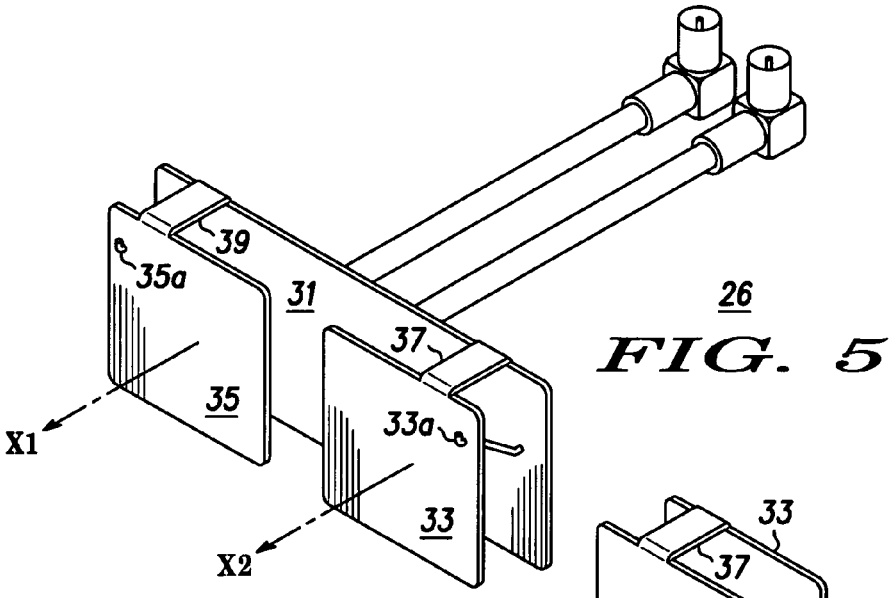
FIG. 5 is a front perspective view of an antenna structure of the form shown in FIG. 3 and shown assembled in the carrier in FIG. 4.
Figure 6:
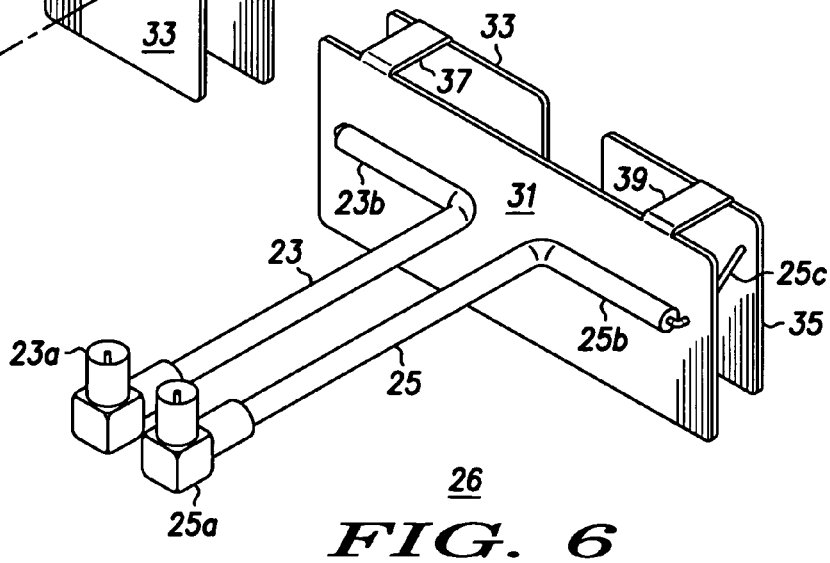
FIG. 6 is a rear perspective view of the antenna structure shown in FIG. 5.
Figure 10:
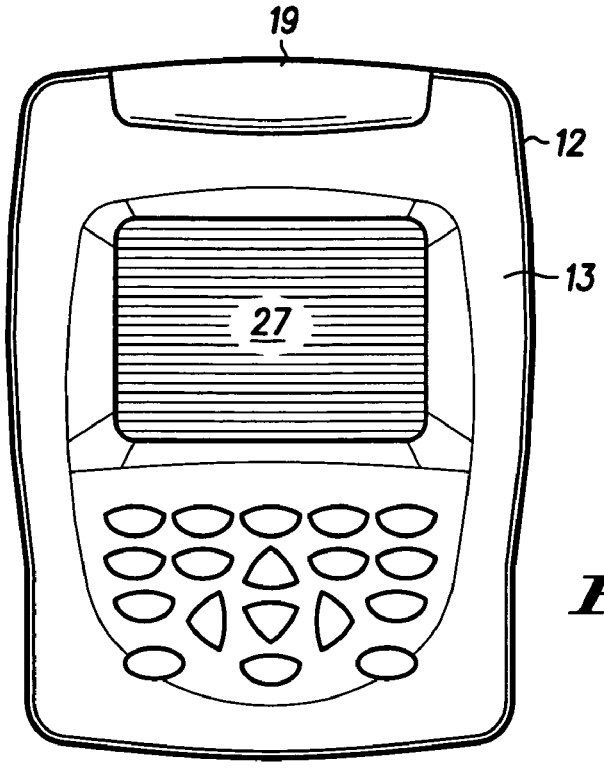
FIG. 10 is a front view of a data communications handset including the carrier shown in FIG. 4.
Figure 11:
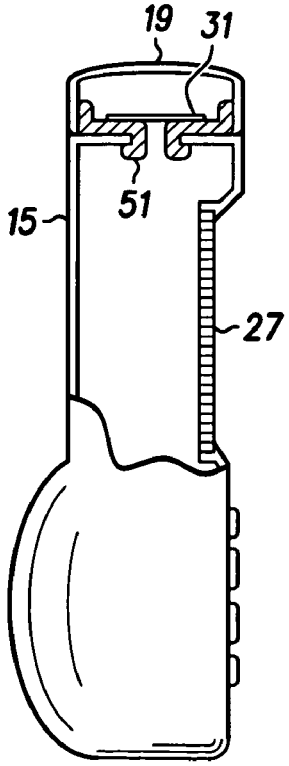
FIG. 11 is a cross-sectional end view (as seen in a direction perpendicular to the plane of FIG. 10) of the data communications handset, shown in FIG. 10.

FIGS. 4, 10 and 11 show a data communications handset of the kind described in Applicant's copending International Patent Application having the published number WO03/02192A. The handset includes two metal covers 13, 15 (shown in FIG. 10, 11) which fit in rims of an insulating (plastics) carrier 12 (shown in FIG. 10) with rubber cushioning rings also in the rims to provide mechanical protection to the covers when fitted to the carrier. The handset in FIG. 4 is labelled 11. FIG. 4 shows the inside of the handset 11 with some components removed for clarity. The cushioning rings between the covers 13 and 15 and carrier are labelled 17 (FIG. 4). The covers 13, 15 (FIGS. 10 and 11) correspond to the second ground plane 7 shown in FIG. 3. Location recesses 16*a*, 16*b* provided on an inner wall of the cover 15 in the corner of the cover 15 also facilitate attachment of the cover 13 thereto by receipt of complementary corner studs (not shown) provided on an inner wall of the cover 13. An antenna housing 19 made of plastics material is fitted in a recess 21 formed in the casing structure provided by the covers 13. Together with the plastics carrier 12 separating the covers 13,15 the housing 19 serves as a dielectric coupling corresponding to the layer 6 of FIG. 3. The antenna housing 19 is at an end of the handset 11 which may be considered as its front end because radiation is transmitted from that end in use. The front facing outer surface of the antenna housing conveniently is flush with the front outer walls of the casing formed by the covers 13 and 15 so that the handset 11 has an overall smooth profile. Cables 23, 25 extend from the antenna housing 19 into the interior of the handset 11 and are connected to a R.F. portion of the handset 11 (not shown in FIG. 1). The R.F. portion transmits and receives R.F. signals via an antenna structure, to be described below, located inside the housing 19. Other components such as a window 27 and circuit components 29 are seen in FIG. 4 but will not be further described because they are not material to the present invention.

Figure 7:
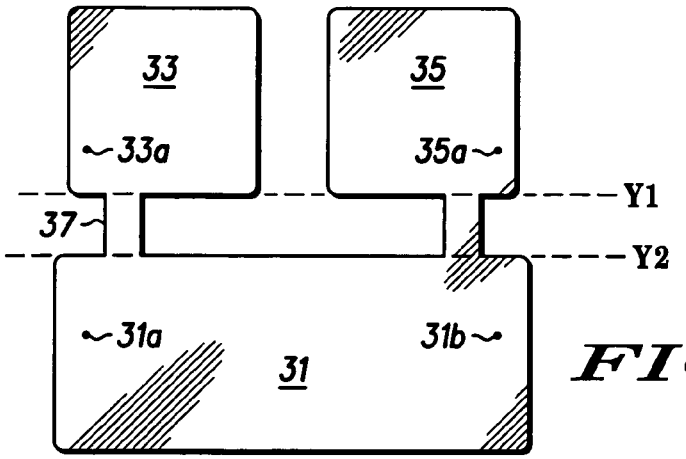
FIG. 7 is a plan view of a shaped metal sheet used in the manufacture of the antenna structure shown in FIG. 5 and FIG. 6.
Figure 8:
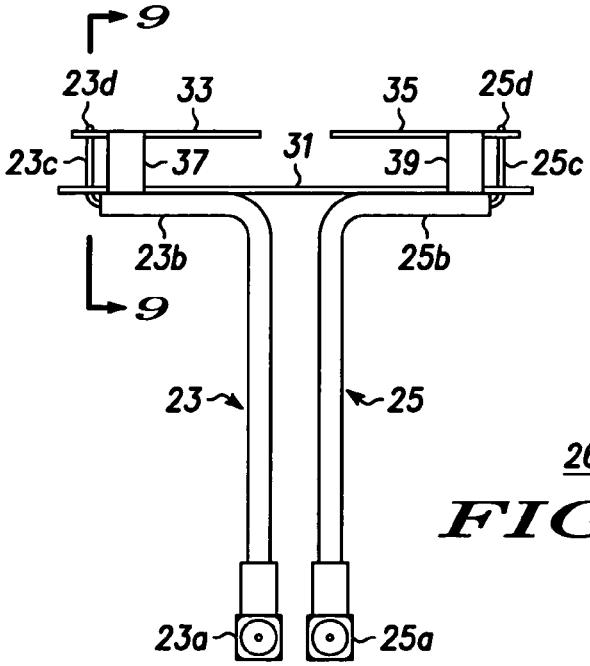
FIG. 8 is a plan view of the antenna structure shown in FIG. 5 and FIG. 6.

FIGS. 5, 6, 7 and 8, and 9 show a two-antenna structure 26 which is incorporated in the antenna housing 19 of FIG. 4 (this is not shown in FIGS. 5 to 9) with the cables 23 and 25 attached to the structure 26. The two-antenna structure 26 comprises two rectangular conducting plates 33, 35 considered to be at the front of the structure 26 and a larger plate 31 which is parallel with the plates 33, 35 and is located behind the plates 33,35 with respect to front of the structure 26 as indicated by forward directions X1 and X2. The plates 33 and 35 are coplanar. The plate 31 is electrically connected to the plates 33, 35 by conducting strips 37, 39 respectively. FIG. 7 shows how the plates 31, 33 and 35 together with the strips 37 and 39 may be manufactured. A single sheet of metal is cut into the shape shown in FIG. 7 to provide the areas to be formed into the plates 31, 33 and 35 and the strips 37 and 39. The sheet is then bent along the axes indicated by broken lines Y1, Y2 shown in FIG. 7.

Figure 9:
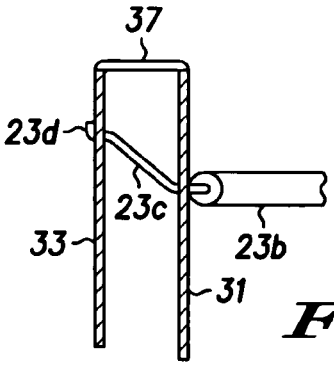
FIG. 9 is an enlarged cross-sectional end view taken on the plane defined by the line 9-9 in FIG. 8 of the antenna structure shown in FIG. 8.

The cables 23 and 25 are co-axial cables having at their ends distant from the plate 31 connectors 23*a* and 25*a* respectively. The cables 23 and 25 have metal outer conductors 23*b* and 25*b* respectively which are soldered to the rear face of the plate 31. Insulated wires 23*c* and 25*c* which are inside the conductors 23*b* and 25*b* respectively in the region behind the plate 31 extend from the sleeves 23*b*, 25*b* through holes 31*a* and 31*b* respectively formed in the plate 31. The insulated wire 23*c* is fed through a hole 33*a* (shown in FIGS. 5,7) in the plate 33 and an inner metal wire 23*d* protruding at the front end of the insulated wire 23*c* is soldered to the front face of the plate 33 as shown in FIG. 9. Similarly, the insulated wire 25*c* is fed through a hole 35*a* (shown in FIG. 7) in the plate 35 and an inner metal wire 25*d* protruding at the front end of the insulated wire 25*c* is soldered to the front face of the plate 35.

In use, R.F. signals are produced in a transmit mode by the R.F. portion of the handset 1 and via the cable 23 or 25 as appropriate and are transmitted by the two antennas depending on the communication mode of the handset 1. Similarly, in a receive mode, incoming signals are received by the two antennas and are passed via the cable 23 or the cable 25 as appropriate to the R.F. portion of the handset. For example, the first antenna (including the plate 33 with ground plate 31) may be used to provide wireless LAN communications and, when the R.F. portion has been suitably switched, the second antenna (the plate 35 with ground plate 31) may be used to provide Bluetooth communications. The centre operational frequency used in each of these communication modes may for example be 2.4 GHz although other frequencies, e.g. typically 5 GHz may be used as will be apparent to those familiar with the high frequency data communications field.

The plate 31 and covers 13 and 15 (as second conducting ground portion) capacitively coupled thereto provide a common ground plane to both these antennas (plates 33 and 35) and thereby beneficially allow the antenna structure to operate in two different modes at high frequency yet beneficially to be constructed in a compact, space saving manner.

The antenna structure shown in FIGS. 5 to 9 desirably has the following dimensions. The plate 31 desirably has an effective electrical length which is equivalent to at least 0.25λ, preferably 0.5λ, where λ is the mean wavelength of radiation to be transmitted and received (for example, for one use where λ is equivalent to 12.28 cm; we have two different modes operating on one frequency band, 2.4-2.485 GHz). The plates 33 and 35 desirably have sides having an effective electrical length which is equivalent to at least 0.16λ. The plates 33 and 35 desirably have a separation distance equivalent to 0.073λ. The distance between the plate 31 and the plates 33 and 35 desirably is equivalent to 0.05λ. The shortest distance from the sides of the plates 33 and 35 to the metal of the covers 13 and 15 in the recess 16 (FIG. 4) is desirably equivalent to 0.05λ.

The metal structure of the covers 13 and 15 thus beneficially provides an additional ground plane to the two antennas (plates 33 and 35) by capacitive coupling, thereby facilitating reduction in space and size of the antenna structure 26 and increased isolation between two antennas (plates 33 and 35).

If produced with these selected optimal dimensions, good antenna performance may be obtained by the antenna structure. For example, an antenna peak gain of +2 dBi and an average gain (over 360 degrees) of −4 dBi in each of the two antennas (plates 33, 35) may be obtained and isolation of at least 12 dB between these antennas (plates 33, 35) may be obtained. At the same time, a null in radiation pattern directed toward the rear of the handset of −20 dB may be obtained which significantly reduces specific absorption rate (and causes the average gain to be less than the peak gain as stated).

The invention claimed is:

1. A wireless communication device including an antenna structure, the antenna structure comprising a) a plurality of antenna portions each having a substantially planar radiating surface; b) a planar conducting ground portion, galvanically connected to each of the antenna portions; wherein the radiating surfaces of the antenna portions are substantially parallel to one another in a side-by-side relationship and are substantially parallel to the planar conducting ground portion located behind the antenna portions with respect to a direction of transmission of radiation from the antenna portions, and wherein the wireless communication device comprises first and second metal covers forming a casing, said planar conducting ground portion separated from said first and second metal covers by a dielectric material, and wherein said communication device includes an antenna housing fitted to said first and second metal covers, said antenna housing incorporating said antenna portions and said conducting ground portion of the antenna structure, and wherein said first and second metal covers are capacitively coupled by said dielectric material to said ground portion, thereby forming a further ground plane by the first and second metal covers.

2. A wireless communication device according to claim 1 wherein the antenna housing is made of a plastics material providing dielectric material giving the capacitive coupling between the casing and the ground portion.

3. A wireless communication device according to claim 2 wherein the casing includes metal covers separated by a plastics carrier, the carrier providing dielectric material giving together with the housing the capacitive coupling between the casing and the ground portion.

4. A wireless communication device according to claim 3 wherein the antenna housing is at an end of the casing which in operation is the front end of the device.

5. A wireless communication device according to claim 4 wherein the antenna structure is operable in multiple communication modes in which different RF signals are transmitted or received by the antenna portions or comprises a multiple antenna structure operable in a single mode in which the same RF signal is transmitted or received by the antenna portions.

6. A wireless communication device according to claim 5 wherein the antenna portions and the ground portion are conducting plates.

7. A wireless communication device according to claim 6 and wherein the plates are of metal bent to form the conducting plates with conducting strips joining the plates of the antenna portions and the plate of the ground portion.

8. A wireless communication device according to claim 7 and wherein the plate which is the ground portion is a substantially rectangular plate and the plates which are antenna portions are substantially square plates.

9. A wireless communication device according to claim 8 and wherein the plates which are antenna portions together define an envelope having an area not greater than that of the plate which is the ground portion.

10. A wireless communication device according to claim 9 wherein the antenna portions provide PIF antennae which in operation provide substantially omnidirectional radiation pattern in an azimuth cut.

* * * * *